US006273112B1

(12) United States Patent
Sumida

(10) Patent No.: US 6,273,112 B1
(45) Date of Patent: Aug. 14, 2001

(54) EXTENDABLE STICK

(75) Inventor: Yuji Sumida, Komatsu (JP)

(73) Assignees: Yuji Sumida, Komatsu; Morito Co., Ltd., Osaka, both of (JP)

( * ) Notice: Subject to any disclaimer, the term of this patent is extended or adjusted under 35 U.S.C. 154(b) by 0 days.

(21) Appl. No.: 09/532,513

(22) Filed: Mar. 21, 2000

(51) Int. Cl.[7] ..... A45B 9/00

(52) U.S. Cl. ..... 135/75; 135/69; 403/109.5; 248/354.1; 280/823

(58) Field of Search ..... 135/75, 69, 25.4, 135/114; 403/109.5, 109.8, 379.2; 463/47.7; 280/823; 248/354.1, 354.6

(56) References Cited

U.S. PATENT DOCUMENTS

| | | | | |
|---|---|---|---|---|
| 2,183,975 | * | 10/1939 | Savage | 135/75 X |
| 2,700,979 | * | 2/1955 | Ries | 135/69 |
| 3,729,012 | * | 4/1973 | Weber | 135/25.4 |
| 4,252,137 | * | 2/1981 | Cohen | 135/75 X |
| 4,283,051 | | 8/1981 | Perez . | |
| 4,782,845 | * | 11/1988 | Chou | 135/75 |
| 4,949,964 | | 8/1990 | Jolly . | |
| 5,351,703 | | 10/1994 | Moe et al. . | |
| 5,573,025 | * | 11/1996 | Atlas | 135/75 X |

FOREIGN PATENT DOCUMENTS

| | | | | |
|---|---|---|---|---|
| 39 05 319 A1 | | 8/1990 | (DE) . | |
| 0 752 554 A1 | | 1/1997 | (EP) . | |
| 63-34307 | | 2/1988 | (JP) . | |
| 2-161971 | | 6/1990 | (JP) . | |
| 93471 | * | 4/2000 | (JP) . | |
| 1734795 | * | 5/1992 | (SU) | 135/75 |

* cited by examiner

*Primary Examiner*—Robert Canfield
(74) *Attorney, Agent, or Firm*—Oliff & Berridge, PLC

(57) ABSTRACT

An extendable stick having an outer pipe, an inner pipe, a core bar fixed on the outer pipe, a zigzag chain having a first portion and a second portion, an unlocking pipe, an unlocking member attached to one end of the unlocking pipe, an unlocking pin, and an unlocking finger grip attached to the unlocking pipe through a hole in the inner pipe by means of the unlocking pin, wherein the first portion being fixed to the inner pipe, the core bar running through the zigzag chain. The stick can optionally have a pedal and/or a spring to provide force to stretch the zigzag chain.

16 Claims, 7 Drawing Sheets

EXTENDABLE STICK

BACKGROUND OF THE INVENTION

1. Field of the Invention

The present invention relates to an extendable stick the length of which can be changed freely.

2. Description of the Prior Art

A stick is an aid for a walker, and is used for safety, for example, for the purpose of supporting the body of the walker. A stick is used mainly by elderly people or physically challenged people who have difficulty in walking normally, but a stick can also be used by hikers. As described above, a stick can be used for a variety of purposes, but a stick is usually a pole the length of which is unchanged.

Since a stick may give the user thereof excessive fatigue or even expose the user to danger when the length thereof is not appropriate for the user, it will be convenient if the length can be adjusted according to the user's height, or leg or arm length. That is, it will be convenient if a stick is so constituted that the length thereof can be changed to enable the stick to support the user's body appropriately. It will be even more convenient if the adjustment can be done infinitely and finely.

A stick that has a length-adjusting mechanism itself may be realized relatively easily by the application of the prior art. However, it is necessary that the adjustment be able to be done easily because the majority of users of a stick are elderly people or physically challenged people who have difficulty in walking normally. It is possible as an example of application of the prior art, to realize a stick which is so constituted that a thin pipe can slide in a thick pipe and that the pipes can be fixed to each other by means of pins or the like. However, with such constitution, it Is not easy to adjust the length.

The user may need a stick to support his body, not only when he walks but, for example, when he stands up, or when he goes upstairs or downstairs. Elderly people or physically challenged people who have difficulty in walking normally, need a stick more often than is expected. In order to use a stick in a variety of situations as described above, it is necessary that the length of a stick be able to be adjusted freely, and it is important that a stick be so constituted that the adjustment may be done easily.

SUMMARY OF THE INVENTION

One object of the present invention is to provide an extendable stick the length of which can be adjusted extremely easily and infinitely.

The above object and others are accomplished by providing an extendable stick that has an outer pipe, an inner pipe, a core bar fixed on the outer pipe, a zigzag chain having a first portion and a second portion, the first portion being fixed to the inner pipe, the core bar running through the zigzag chain, wherein the zigzag chain is so adapted as to form an inner space when it is folded to be zigzag and, a means for releasing the fixed length of the stick by moving the second portion of the zigzag chain in the direction that increase the cross-sectional area of the inner space of the zigzag chain.

BRIEF DESCRIPTION OF THE DRAWINGS

Embodiments of the present invention will now be described with reference to the accompanying drawings, in which.

DETAILED DESCRIPTION OF PREFERRED EMBODIMENTS

Embodiment 1

Figure 1:
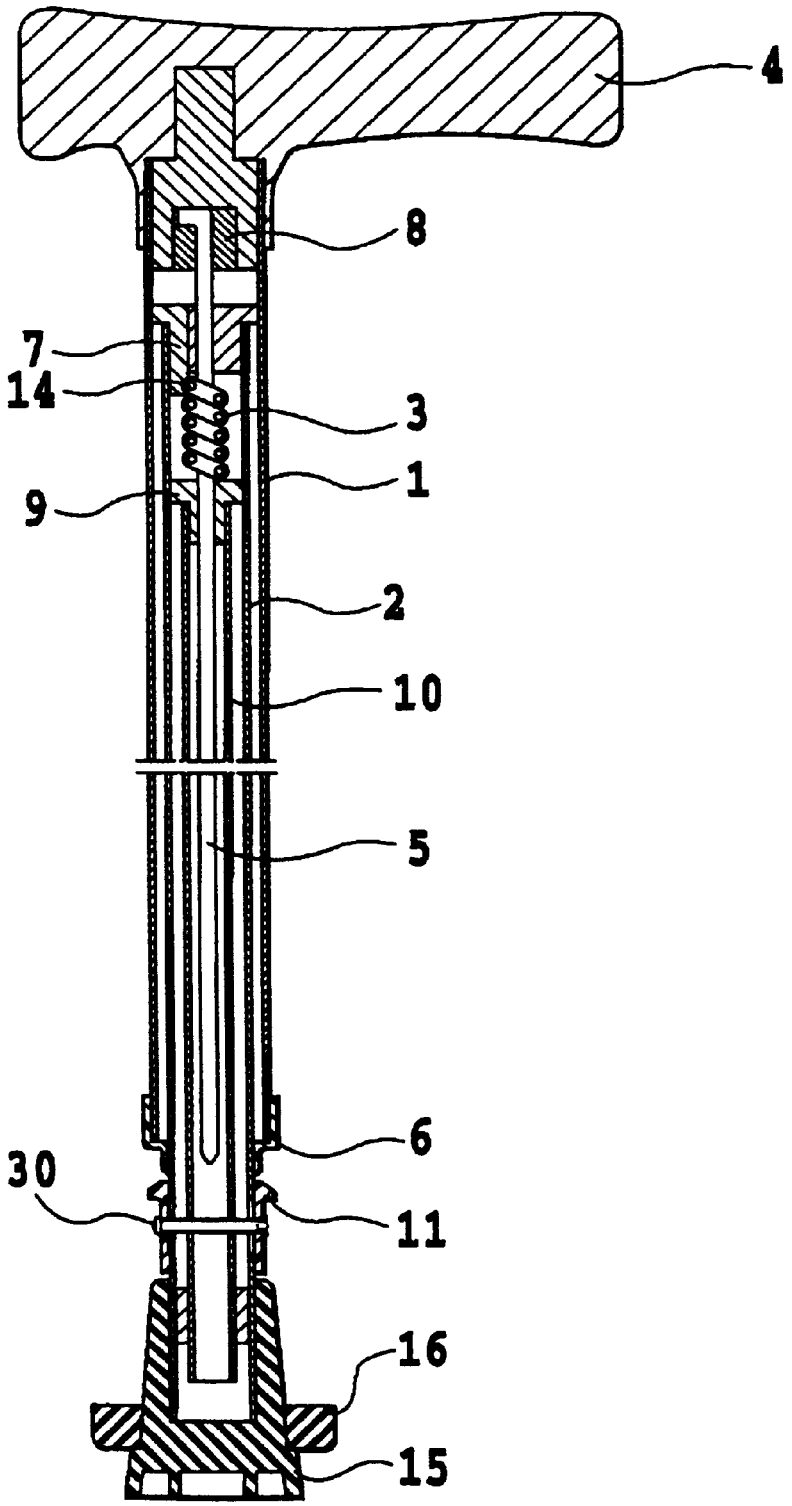
FIG. 1 illustrates an extendable stick according to the first embodiment of the present invention.

FIG. 1 illustrates an extendable stick according to the first embodiment of the present invention. In this embodiment, the numeral 1 represents an outer pipe, the numeral 2 represents an inner pipe, the numeral 3 represents a zigzag chain, the numeral 4 represents a grip, and the numeral 5 represents a core bar. The core bar 5 is fixed to the outer pipe 1 at the upper part of the outer pipe, and extends downward inside the outer pipe. More concretely, the core bar 5 is bent into the form of an L at the upper end thereof and is fixed to a core bar holder 8 that is fixed to the outer pipe 1 at the upper part of the outer pipe 1, such that the core bar 5 is fixed to the outer pipe 1. The grip 4 is fixed to the upper end of the outer pipe 1. The inner pipe 2 having a smaller diameter can slide in the outer pipe 1 having a bigger diameter, such that the stick is extendable. A guide cap 6 which holds the outer side of the inner pipe 2 when the inner pipe 2 slides in the outer pipe 1 is attached to the lower end of the outer pipe 1 such that the inner pipe 2 can slide stably. A chain-fixing member 7 that fixes the upper end 14 of the zigzag chain 3 to the inner pipe 2 is attached to the upper part of the inner pipe 2. A part of the chain-fixing member 7 can be so formed as to be in contact with the inner side of the outer pipe 1, such that the pipe 2 can slide more stably.

Figure 2A:
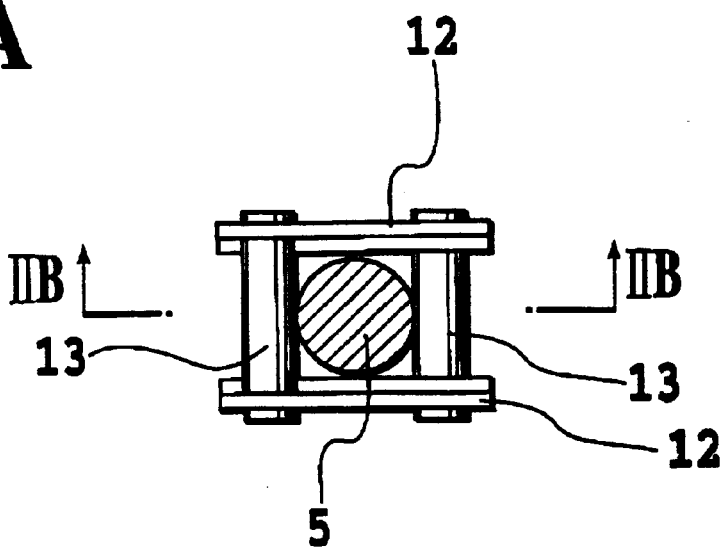
FIG. 2A shows a cross sectional view of a core bar and a zigzag chain of the extendable stick according to the first embodiment of the present invention.
Figure 2B:
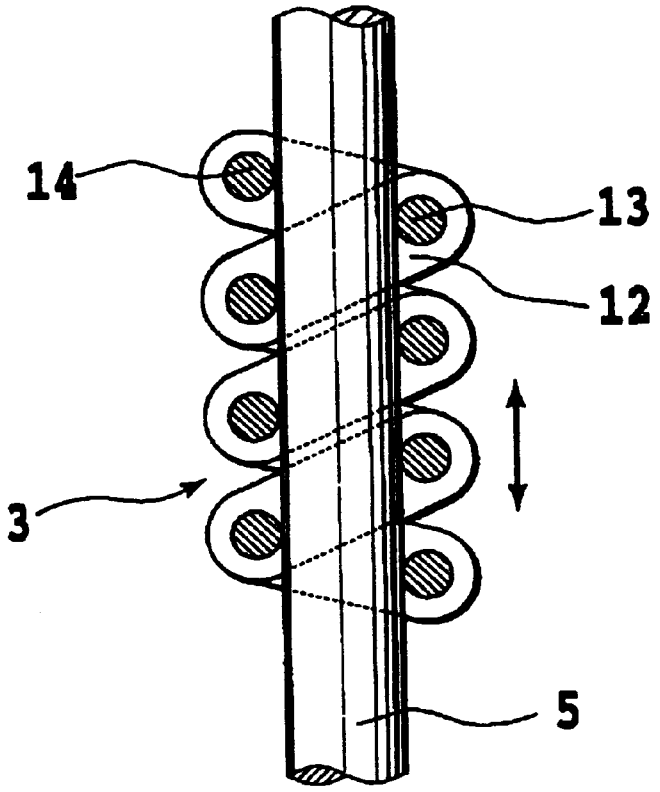
FIG. 2B shows a cross sectional view taken substantially along the line IIB—IIB of FIG. 2A.

The core bar 5 which is fixed to the upper part of the outer pipe 1 and which extends downward runs through the inner space of the zigzag chain 3. FIG. 2A and FIG. 2B show a relationship between the core bar 5 and the zigzag chain 3 of the extendable stick. The zigzag chain 3 is so constituted that a plurality links 12, 12 . . . are connected to each other by means of pins 13, 13 . . . in such a way that the zigzag chain 3 can be bent freely. The zigzag chain 3 is somewhat similar to a bicycle chain.

If the zigzag chain 3 as described above is bent so as to zigzag, the pins 13, 13 . . . are spaced in two parallel rows, thereby forming the inner space that penetrates between pins. The core bar 5 runs through this inner space.

The upper end 14 of the zigzag chain 3 is attached to the chain-fixing member 7 fixed to the inner pipe 2. The lower end of the zigzag chain 3 is usually kept free, but when an unlocking finger grip 11 is moved upward and an unlocking member 9 is also moved upward along with the unlocking finger grip 11, the lower end of the zigzag chain 3 is pushed up. If the lower end of the zigzag chain 3 is pushed up, the angle between each link of the zigzag chain 3 will decrease, that is, the cross-sectional area of the inner space of the zigzag chain 3 will increase so that the frictional force between the core bar 5 and the zigzag chain 3 will diminish. Therefore, the locking mechanism which prevents the stick from being shortened against the force that works to shorten the stick and that will be discussed in further detail below is released (unlocked), and accordingly the inner pipe 2 can be pushed into the outer pipe 1.

The unlocking member 9 is connected to an unlocking pipe 10 that extends downward inside the inner pipe 2. The unlocking pipe 10 is connected to the unlocking finger grip 11 at the lower part of the inner pipe 2 through a hole at the lower part of the inner pipe 2 by means of an unlocking pin 30. The hole at the lower part of the inner pipe 2 is so formed as to be bigger than the unlocking pin 30 vertically, such that the unlocking finger grip 11 can be moved upward a little, allowing the relative position of the inner pipe 2 to the unlocking pipe 10 to be changed a little so that the lower end of the zigzag chain 3 is pushed up as mentioned above.

Figure 3:
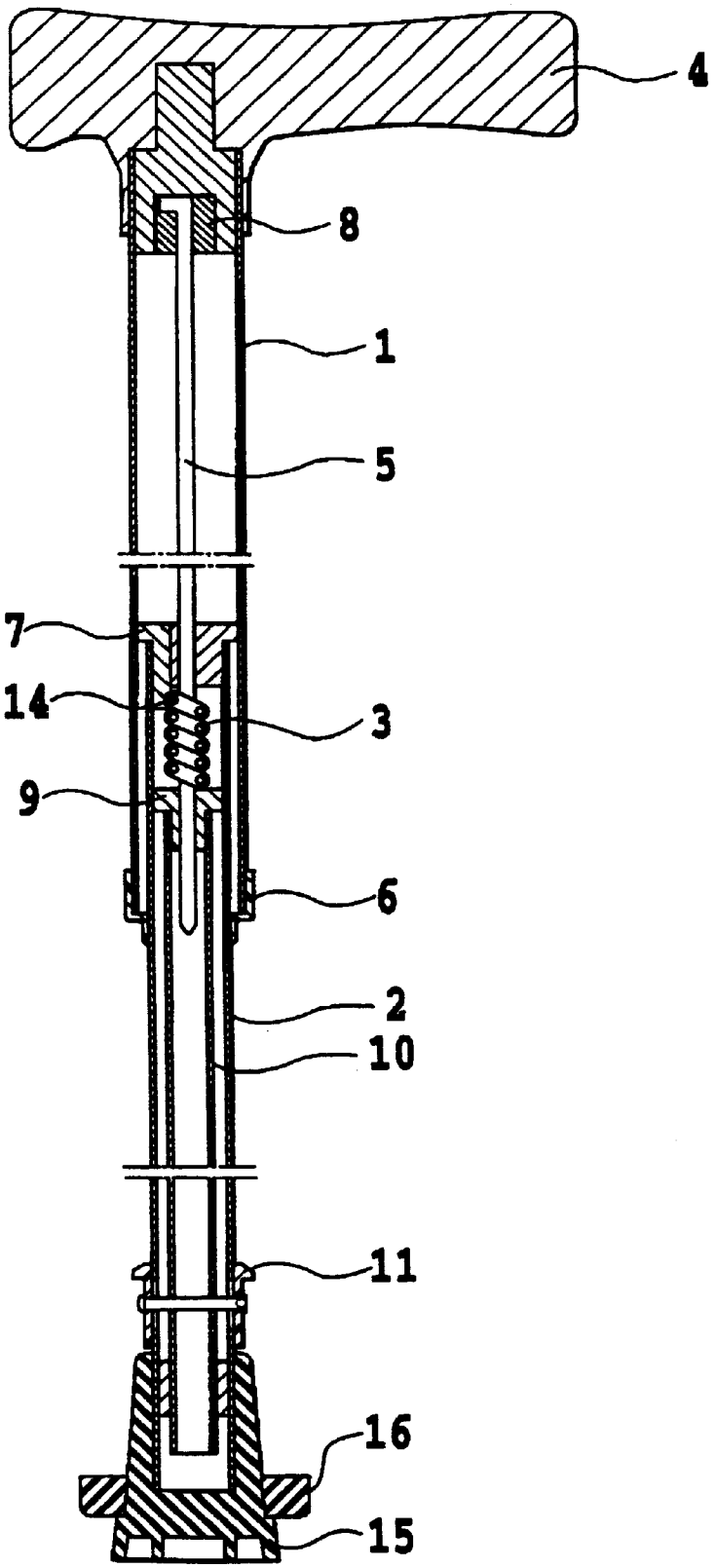
FIG. 3 shows the extendable stick according to the first embodiment of the present invention wherein the stick is lengthened.

Now we consider the case in which a downward force is applied to the grip 4 of the stick when the stick is used. The upper end 14 of the zigzag chain 3 is attached to the chain-fixing member 7 that is attached to the inner pipe 2. That is, the upper end 14 of the zigzag chain 3 is attached to the inner pipe 2 indirectly. The core bar 5 is fixed to the core bar holder 8 that is fixed to the outer pipe 1. That is, the core bar 5 is fixed to the outer pipe 1 indirectly. Accordingly, if a downward force is applied to the grip 4 of the stick when the stick is used, the force will work to pull up the upper end 14 of the zigzag chain 3 through which the core bar 5 runs. The force, however, will work to increase angle between each link of the zigzag chain 3, in other words, the force will work to decrease the cross-sectional area of the inner space of the zigzag chain 3 so that the friction between the core bar 5 and the zigzag chain 3 will increase. Accordingly, even when the downward force is applied to the grip 4 of the stick, the frictional force prevents the inner pipe 2 from being pushed into the outer pipe 1, that is, the locking mechanism works. Thus, the stick according to the present invention can function as a stick in practice. FIG. 3 shows the extendable stick according to the first embodiment of the present invention that is lengthened. To the tip (lower end) of the inner pipe is attached a rubber slip resistance 15 that has a pedal 16 the outer diameter of which is formed to be relatively bigger.

As described above, the locking mechanism of the present invention utilize the frictional force between the zigzag chain 3 and the core bar 5. In order for the locking mechanism to work when the force works to pull up the upper end 14 of the zigzag chain 3 through which the core bar 5 runs, the frictional force between the zigzag chain 3 and the core bar 5 needs to arise effectively. For this purpose, it could be necessary to process the surface of the zigzag chain 3 and/or the core bar 5, to chose the appropriate material for the zigzag chain 3 and/or the core bar 5, or to adjust the shape or the size of the cross-section of the zigzag chain 3 and/or the core bar 5 depending on a particular application. These can be easily accomplished by those skilled in the art depending on the particular application. In order for the frictional force to arise effectively between the zigzag chain 3 and the core bar 5 when the force works to pull up the upper end 14 of the zigzag chain 3 through which the core bar 5 runs, the force of spring can be utilized. In order for the frictional force to arise effectively, it is necessary that the cross-sectional area of the inner space of the zigzag chain 3 will decrease. For this purpose, the force of spring needs to be applied in the direction that allows the zigzag chain 3 itself to stretch. For this purpose, it is possible to utilize the force of spring of an elastic wire by attaching a wire that is zigzag to the zigzag chain 3. It is also possible to connect the unlocking member 9 and to the lower end of the zigzag chain by means of a spring.

Next we consider the case in which the user lengthens the stick. This is the case in which the inner pipe 2 is pulled out of the outer pipe 1. In this case, the force will work to push down the upper end 14 of the zigzag chain 3 through which the core bar 5 runs. The force will work to decrease the angle between each link of the zigzag chain 3, in other words, the force will work to increase the cross-sectional area of the inner space of the zigzag chain 3 so that the friction between the core bar 5 and the zigzag chain 3 will diminish. Accordingly, the inner pipe 2 can be pulled out of the outer pipe 1 since the locking mechanism which utilizes the frictional force does not work when the user lengthens the stick. Since the locking mechanism does not work when the user pulls the inner pipe 2 out of the outer pipe 1, if the user puts his toe on the pedal 16 and lifts up the grip 4, the inner pipe 2 will be pulled out of the outer pipe 1 so that the user can lengthen the stick. The stick according to the present invention can be really convenient since the stick once shortened can be easily lengthened to the length the user desires. In order to shorten the stick, the user only needs to move the unlocking finger grip 11 upward a little and exert the force to push the inner pipe 2 into the outer pipe 1. When the grip 4 comes to an appropriate height, the user can release the unlocking finger grip 11.

Embodiment 2

Figure 4:
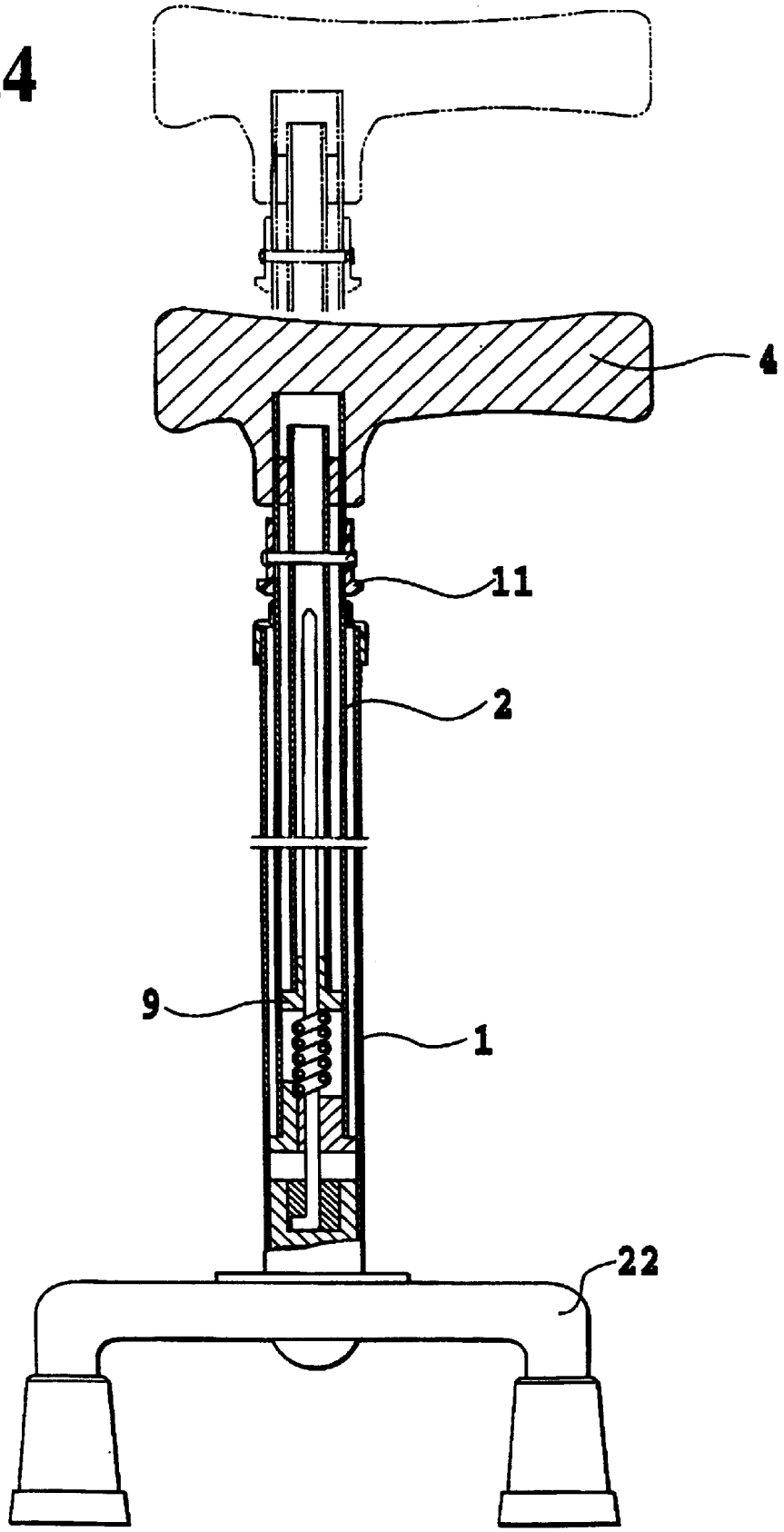
FIG. 4 illustrates an extendable stick according to the second embodiment of the present invention.

FIG. 4 Illustrates an extendable stick according to the second embodiment of the present invention. The extendable stick of this embodiment only substantially differs from the extendable stick in that the position of the locking mechanism is reversed. That is, the stick comprises an outer pipe 1 and an inner pipe 2, the inner pipe 2 being placed above the outer pipe 1, wherein a grip 4 is attached to the upper end of the inner pipe 2 and a leg 22 is attached to the tip (lower end) of the outer pipe 1. If the user puts the toe on the leg 22 and lifts up the grip 4, the inner pipe 2 is pulled out of the outer pipe 1 so that the stick is lengthened. In order to shorten the stick, the user only needs to move the unlocking finger grip 11 downward a little and exert the force to push the inner pipe 2 into the outer pipe 1. When the grip 4 comes to an appropriate height, the user can release the unlocking finger grip 11. In this case, however, since the unlocking finger grip 11 is placed close to the grip 4, it is preferable to prevent the unlocking finger grip 11 from being moved downward without the user's intention. For this purpose, it is possible and preferable to utilize the force of spring discussed above in order to increase the frictional force between the zigzag chain 3 and the core bar 5.

In this embodiment, the lower end of the zigzag chain 3 is fixed to the inner pipe 2 but the upper end of the zigzag chain 3 is kept free. The gravity will work to decrease the angle between each link of the zigzag chain 3, in other words, the force will work to increase the cross-sectional area of the inner space of the zigzag chain 3 so that the friction between the core bar 5 and the zigzag chain 3 will diminish. Therefore, in order for the frictional force to arise effectively, it is necessary that the cross-sectional area of the inner space of the zigzag chain 3 will decrease. The force of spring discussed above needs to be applied in the direction that allows the zigzag chain 3 itself to stretch.

Embodiment 3

In the extendable stick according to the first embodiment or the second embodiment of the present invention, when a downward force is applied to the grip 4, the locking mechanism works to prevent the inner pipe 2 from being pushed into the outer pipe 1, but when the user pull the inner pipe 2 out of the outer pipe 1, the locking mechanism does not work. It will be advantageous if the locking mechanism does not work when the user pull the inner pipe 2 out of the outer pipe 1, in that the user can lengthen the stick by putting his toe on the pedal 16 of the first embodiment or the leg 22 of the second embodiment and lifting up the grip 4. However, it is also possible to constitute the stick in such a way that the inner pipe 2 is prevented from being pulled out freely.

Figure 5:
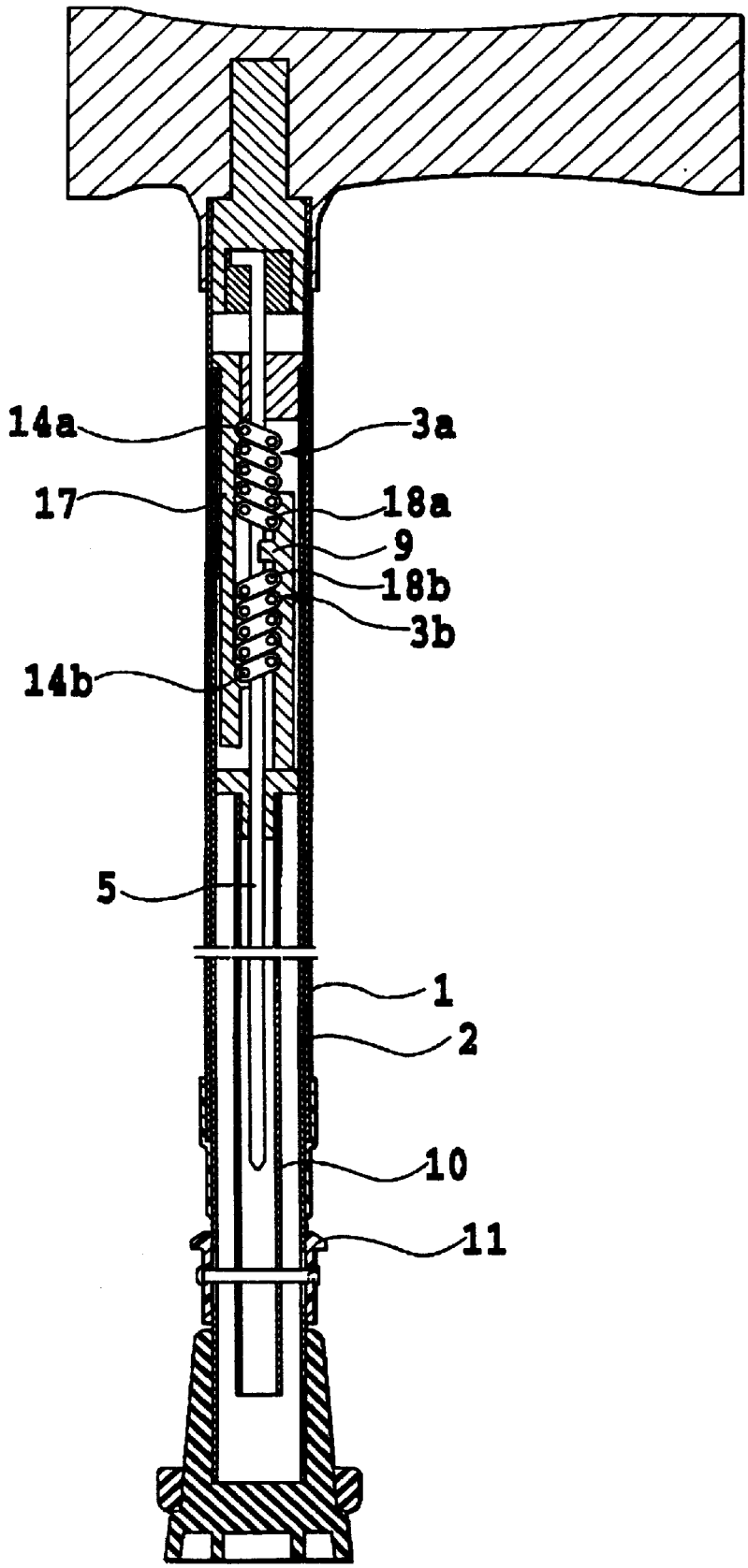
FIG. 5 illustrates an extendable stick according to the third embodiment of the present invention.

FIG. 5 illustrates an extendable stick according to a third embodiment of the present invention. The basic difference of the stick of this embodiment from those of the first and second embodiments is that the stick of the third embodiment employs two of the zigzag chains described above. The purpose of a zigzag chain 3*a* is to lock, or fix the inner pipe 2 to prevent the inner pipe 2 from being pushed into the outer pipe 1, whereas the purpose of a zigzag chain 3*b* is to lock, or fix the inner pipe 2 to prevent the inner pipe 2 from being pulled out of the outer pipe 1. The upper end of the zigzag chain 3*a* and the lower end of the zigzag chain 3*b* are fixed to a chain-fixing member 17.

Figure 6:
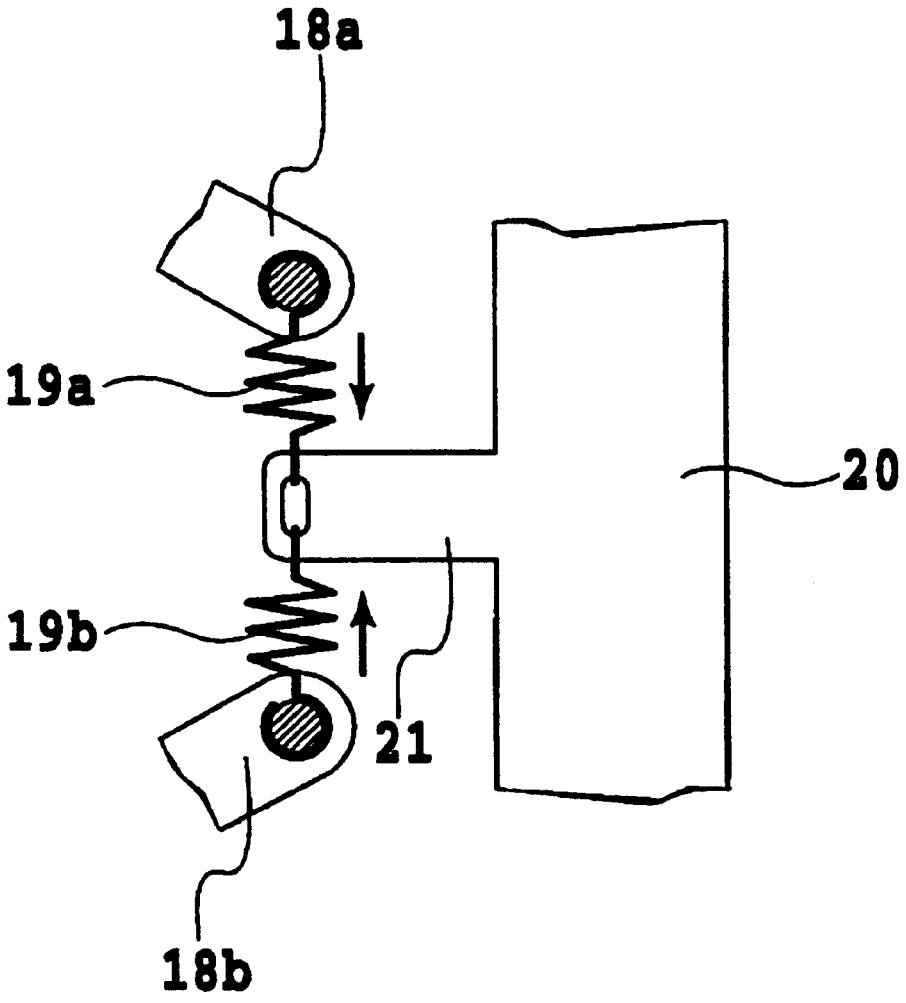
FIG. 6 illustrates coiled springs of the extendable stick according to the third embodiment of the present invention, that connect zigzag chains to an arm of an unlocking member.
Figure 7A:
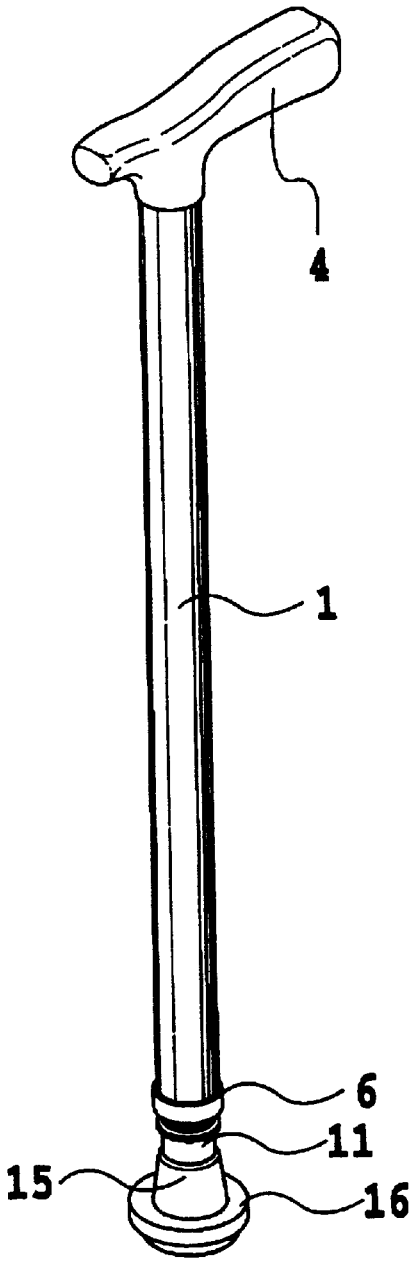
FIG. 7A shows the extendable stick according to the first embodiment of the present invention wherein the stick is shortened.
Figure 7B:
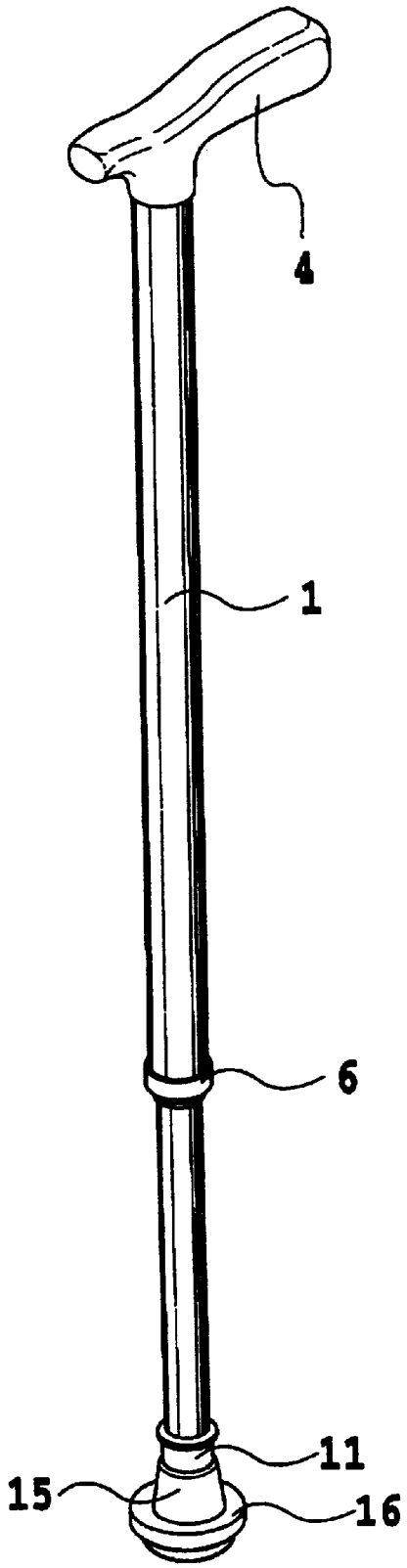
FIG. 7B shows the extendable stick according to the first embodiment of the present invention wherein the stick is lengthened.

As shown in FIG. 6, the lower end 18*a* of the zigzag chain 3*a* and the upper end 18*b* of the zigzag chain 3*b* are connected to an arm 21 of an unlocking member via coiled springs 19*a* and 19*b*, respectively. The forces of spring of the coiled springs 19*a* and 19*b* work so that the zigzag chains 3*a* and 3*b* will be stretched. Accordingly, whether a force is applied in the direction that allows the stick to be lengthened or shortened, the locking mechanism works so that the stick will not be lengthened nor shortened. Therefore, the user who wish to pull the inner pipe 2 out of the outer pipe 1 to lengthen the stick has to release the lock, or the fixed length of the stick by moving the unlocking finger grip 11 downward a little. On the other hand, the user who wish to push the inner pipe 2 into the outer pipe 1 to shorten the stick has to release the lock, or the fixed length of the stick by moving the unlocking finger grip 11 upward a little.

In this case, too, as a means for stretching the zigzag chain 3*a* and/or the zigzag chain 3*b*, it is possible to utilize the force of spring of an elastic wire, by attaching a wire that is zigzag to the zigzag chain 3, instead of or in combination with the coiled springs 19*a* and 19*b*.

The terms and expressions which have been employed are used as terms and expressions of description and not of limitation, and there is no intention in the use of such terms and expressions of excluding any equivalent of the features shown and described, but it is recognized that various modifications are possible within the scope of the appended claims.

What is claimed is:

1. An extendable stick comprising:

an outer pipe, an inner pipe, a core bar fixed on said outer pipe, a zigzag chain having a first portion and a second portion, the first portion being fixed to the inner pipe, the core bar running through the zigzag chain, wherein the zigzag chain is so adapted as to form an inner space when it is folded to be zigzag and, a means for releasing the fixed length of the stick by moving the second portion of the zigzag chain in the direction that increases a cross sectional area of the inner space of the zigzag chain.

2. The extendable stick as claimed in claim 1, wherein the first portion is the upper end of the zigzag chain.

3. The extendable stick as claimed in claim 1, wherein the second portion is the lower end of the zigzag chain.

4. The extendable stick as claimed in claim 1, wherein the first portion is the upper end of the zigzag chain and the second portion is the lower end of the zigzag chain.

5. The extendable stick as claimed in claim 1, wherein the first portion is the lower end of the zigzag chain.

6. The extendable stick as claimed in claim 1, wherein the second portion is the upper end of the zigzag chain.

7. The extendable stick as claimed in claim 1, wherein the first portion is the lower end of the zigzag chain and the second portion is the upper end of the zigzag chain.

8. The extendable stick as claimed in claim 1, wherein the extendable stick further comprises a pedal.

9. The extendable stick as claimed in claim 1, wherein the inner pipe has a hole and the means for releasing the fixed length of the stick comprises:

an unlocking pipe, an unlocking member attached to one end of the unlocking pipe, an unlocking pin, and an unlocking finger grip attached to the unlocking pipe through the hole in the inner pipe by means of the unlocking pin.

10. The extendable stick as claimed in claim 9, wherein the extendable stick further comprises a means for exerting a force to stretch the zigzag chain.

11. The extendable stick as claimed in claim 10, wherein the means for exerting a force to stretch the zigzag chain comprises a spring placed between the unlocking member and the second portion.

12. The extendable stick as claimed in claim 1, wherein the extendable stick further comprises a means for exerting a force to stretch the zigzag chain.

13. The extendable stick as claimed in claim 9, wherein the extendable stick further comprises a pedal.

14. The extendable stick as claimed in claim 13, wherein the extendable stick further comprises a means for exerting a force to stretch the zigzag chain.

15. The extendable stick as claimed in claim 14, wherein the means for exerting a force to stretch the zigzag chain comprises a spring placed between the unlocking member and the second portion.

16. The extendable stick as claimed in claim 12, wherein the extendable stick further comprises a pedal.

* * * * *